US008752225B2

(12) United States Patent
Meheen

(10) Patent No.: US 8,752,225 B2
(45) Date of Patent: Jun. 17, 2014

(54) TUNABLE LOAD SHARING ARCH BRIDGE

(76) Inventor: H. Joe Meheen, Denver, CO (US)

( * ) Notice: Subject to any disclaimer, the term of this patent is extended or adjusted under 35 U.S.C. 154(b) by 425 days.

(21) Appl. No.: 12/437,674

(22) Filed: May 8, 2009

(65) Prior Publication Data

US 2010/0281632 A1 Nov. 11, 2010

(51) Int. Cl.
*E01D 4/00* (2006.01)

(52) U.S. Cl.
USPC ..... 14/2; 14/24

(58) Field of Classification Search
USPC ..... 14/4, 13, 18, 19, 20, 2, 24–26
See application file for complete search history.

(56) References Cited

U.S. PATENT DOCUMENTS

| | | | | | |
|---|---|---|---|---|---|
| 15,823 | A | * | 9/1856 | Rogers | 14/24 |
| 16,572 | A | * | 2/1857 | Moseley | 14/3 |
| 25,210 | A | * | 8/1859 | Montgomery | 14/13 |
| RE2,586 | E | * | 4/1867 | Hammond | 14/13 |
| RE3,433 | E | * | 5/1869 | Laird et al. | 14/13 |
| 94,322 | A | * | 8/1869 | Hammond | 14/13 |
| 102,393 | A | * | 4/1870 | Hammond et al. | 14/13 |
| 119,466 | A | * | 10/1871 | Kittinger | 14/9 |
| 120,282 | A | * | 10/1871 | Kirkups | 14/13 |
| 125,128 | A | * | 4/1872 | Fovargue | 14/25 |
| 142,381 | A | * | 9/1873 | Eads | 14/25 |
| 144,751 | A | * | 11/1873 | Evans | 14/13 |
| 146,397 | A | * | 1/1874 | Long | 14/9 |
| 146,916 | A | * | 1/1874 | Laird | 14/13 |
| 148,010 | A | * | 2/1874 | Wall | 14/13 |
| 159,084 | A | * | 1/1875 | Farnsworth | 14/13 |
| RE6,446 | E | * | 5/1875 | Eads | 14/26 |
| 175,165 | A | * | 3/1876 | Reicherts | 14/25 |
| 391,463 | A | * | 10/1888 | Ellis | 14/24 |
| 3,654,652 | A | * | 4/1972 | Pleasants | 14/18 |
| 4,691,399 | A | * | 9/1987 | Kim et al. | 14/2 |
| 6,138,309 | A | * | 10/2000 | Tadros et al. | 14/25 |
| 6,401,285 | B1 | * | 6/2002 | Morris | 14/19 |
| 7,146,672 | B1 | * | 12/2006 | Meheen | 14/2 |
| 7,469,438 | B2 | * | 12/2008 | Li et al. | 14/24 |

* cited by examiner

*Primary Examiner* — Gary Hartmann

(57) ABSTRACT

A method and apparatus for adjusting the live and dead load balance between the arches of an arch bridge and the truss girder that supports the bridge deck. The method is achieved by providing hanger rods disposed between the arches and the top chords of the truss girder whose compression may be adjusted. In which the arch truss counter act the compression in the top chord of the truss. This interaction adds to the strength and safety of both elements of the structure. With this interaction there are no critical members which can cause catastrophic failure of the bridge by failing. By combining two of these bridges side by side, and then connected with the lateral members, both at top and bottom chord of trusses, it is possible to carry vehicular, train, and pedestrian lanes separated and accommodated with safety; all without a critical member.

1 Claim, 5 Drawing Sheets

TUNABLE LOAD SHARING ARCH BRIDGE

FIELD OF THE INVENTION

The present invention relates to a combination arch and truss girder that can serve as a bridge, roof truss or any other long span beam.

BACKGROUND OF THE INVENTION

In my prior U.S. Pat. No. 7,146,672 I disclosed a tunable load sharing double arch bridge where the terminal ends of the arches are anchored to the ends of the lower chords of a truss girder deck. A tension member spans the lower chords of the truss girder deck and a plurality of spaced apart adjustable hanger rods interconnect each arch and the respective lower chord of the truss girder deck. Dead and live loads on the bridge structure are shared between the truss girder and the arches as a function of the respective tension adjustment in the tension member/s that span the lower chords and the tension forces in the hanger rods. Tension that is created in the member that spans the lower chord creates compression in the lower chord of the truss girder. Accordingly, the compression reduces the dead load tension forces in that lower chord. Live loads are shifted to the arches by adjusting the tension forces within the hanger rods that depend from the arches. By judicious adjustment of the respective tensions in the spanning member/s and the hanger rods the sharing of live and dead loads can be apportioned between the truss girder and the arches. Such allocation of forces permits the use of lighter weight structural materials and easier and less expensive construction costs.

The primary benefits of the invention disclosed in the '672 patent are achieved in the first instance by the tension member that spans the lower chord of the truss girder. The object of the present invention is to eliminate or at least significantly reduce the size of the spanning tension member while still achieving the same result, that is, reducing or eliminating the tension in the lower chord of the truss girder. When tension is reduced or eliminated in the lower chord the compression forces in the upper chord are also equalized.

A second objective of the present invention is to reduce the size and cost of materials necessary to construct a bridge by judiciously allocating the dead and live loads between various structural members of the bridge.

A further object of the invention is to create a bridge in which there is no critical structural member, thus eliminating the possibility of catastrophic failure of the structure upon the failure of one member.

A still further object of the invention is to provide a combination arch and beam where the tension and compression in the respective bottom and top flanges of the beam are equalized by the arch and its novel attachment to the beam.

Other and still further objects, features and advantages of the invention will become apparent upon a reading of the following detailed description of a preferred form of the invention taken in conjunction with the accompanying drawings.

SUMMARY OF THE INVENTION

In its most primitive form, the invention can be described by reference to an ordinary flanged beam that spans the space between two supporting bearings. The beam's own weight creates a downward deflection of the beam that creates tension in the lower flange and compressive forces in the upper flange. In accordance with the present invention, these dead load forces are equalized in all or some central part of the beam by securing the terminal ends of a surmounted arch to the top flange of that portion of the beam between the ends of which it is desired to equalize the dead load compression and tension forces that are inherent in the top and bottom flanges of the suspended beam. In operation, the thrust forces existing at the terminal ends of the arch tend to cancel or equalize the compressive forces in the top flange. When the compression is equalized or reduced in the top flange, the tension in the bottom flange is likewise equalized or reduced. Thus, the presence of an arch whose terminal ends are attached to the top flange of the beam reduces the size of the beam necessary to carry the live or dead loads.

The foregoing example of the invention applied to a simple flanged beam is easily extrapolated to the truss girder deck of a bridge or the roof truss of a football stadium. In such cases the hanger rods depending from the arch are connected to the top chord of the truss girder.

DETAILED DESCRIPTION OF PREFERRED EMBODIMENT

Figure 1:
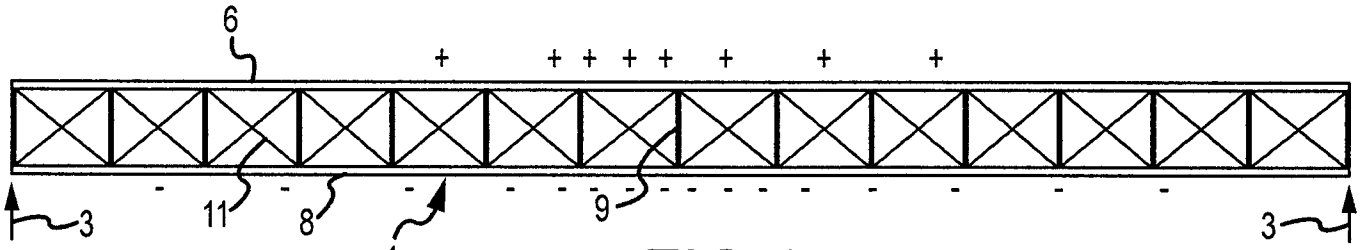
FIG. 1 is a side elevational view of a basic truss girder. Tension (−) and compression (+) in the respective bottom and top chords of the truss girder are depicted.

Referring first to FIG. 1, a basic truss girder 4 is shown supported at each of its ends by bearings 3. The girder comprises upper and lower longitudinal chords 6 and 8, vertical members 9 and cross braces 11 disposed between the vertical members. The weight or dead load of the truss itself creates downward deflection in the center of the truss resulting in tension forces (−) in the lower chord 8 and compression (+) in the upper truss chord 6. A similar truss girder could be employed as a bridge, roof truss or similar article.

Figure 2:
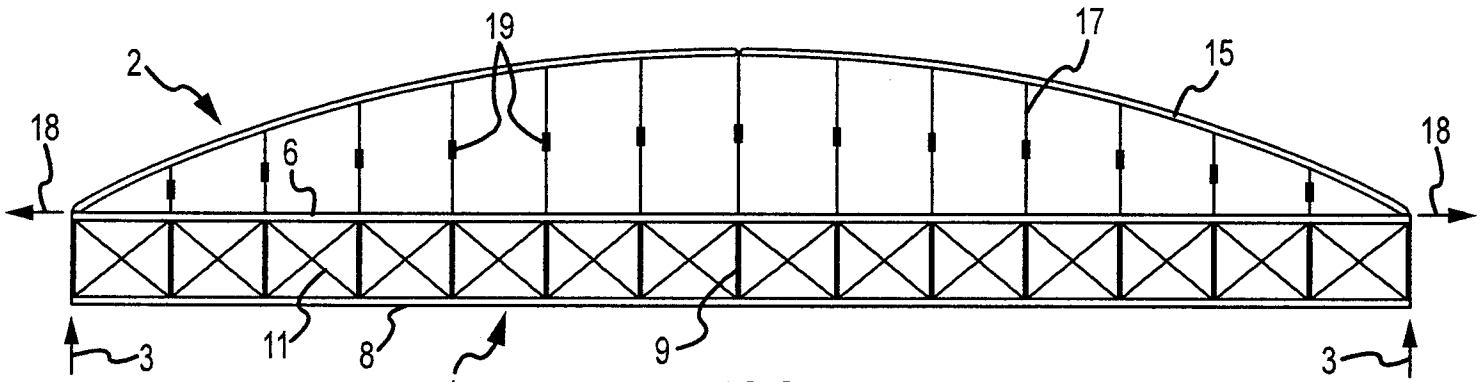
FIG. 2 is a side elevational view of a truss girder with an arch secured to the top chord in accordance with the present invention.

In FIG. 2 of the drawings an arch 15 is surmounted over the truss 4 and each of the terminal ends of the arch is attached to the respective ends of the top chord 6. A plurality of spaced apart hanger rods 17 interconnect the top truss chord 6 and the arch 15. By attaching the ends of the arch 15 to the ends of the top truss chord 6, the opposing thrust forces 18 inherent in the arch 15 tend to equalize or significantly reduce the compression forces (+) in the top chord. Reducing the compression forces in the top chord 6 results in a reduction of the tension forces in the lower truss chord 8. The advantages realized by the spanning tension rod disclosed in U.S. Pat. No. 7,146,672 are largely, if not completely, achieved by the structure of the present invention. Moreover, by complimenting the hanger rods 17 with tension adjustment turnbuckles 19 the entire structure may be tuned so that the dead and live loads are appropriately allocated between the truss girder 4 and the arch 15.

Figure 3:
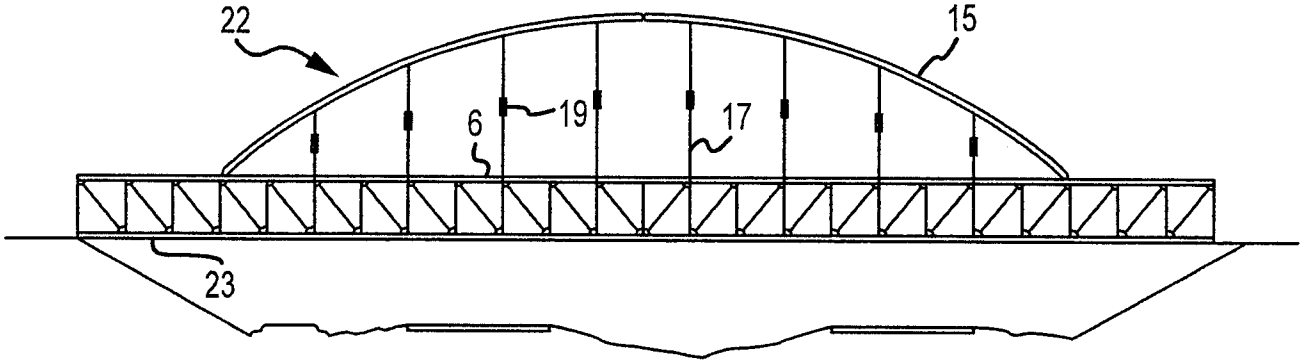
FIG. 3 is a side elevational view of an elongated truss girder acting as a bridge with an arch spanning the central portion of the girder in accordance with the present invention.

FIG. 3 generally illustrates the use of the arch and truss combination as a bridge 22 having a road deck 23 laid on cross members that interconnect a pair of laterally spaced apart lower truss chords 8. In this embodiment of the invention the dual arches 15 do not span the entire length of the truss girder but only that central portion thereof that requires additional strength.

Figure 4:
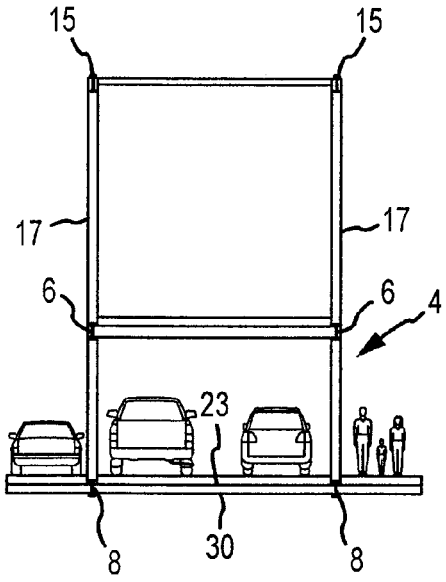
FIG. 4 is an end view of a bridge embodiment of the present invention with a plurality of roadway decks supported by the bottom chords of a truss girder.
Figure 5:
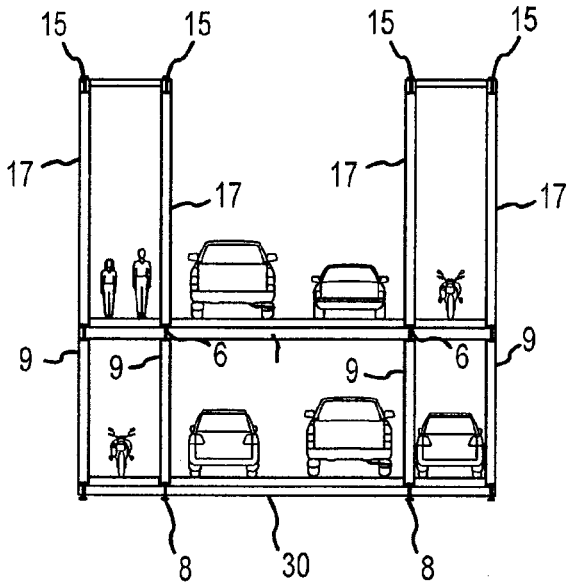
FIG. 5 is an end view of a second bridge embodiment of the present invention with a plurality of roadway decks supported by both the bottom and top chords of a plurality of truss girders and arches.

FIGS. 4 and 5 illustrate two of many possible embodiments of the invention when used as a bridge. In FIG. 4 the lower chords 8 of the truss girder 4 are interconnected by floor joists 30 which support the road deck 23. The floor joists may be cantilevered outwardly from the lower chords 8 to support road or walk ways for emergency vehicles or pedestrians.

FIG. 5 is an illustration of an embodiment of the invention where both the lower chords and upper chords of the truss girder are employed to support roadway decks. In addition to a road deck supported by the lower chords of the truss, a road deck is laid on cross members 32 that interconnect the upper chords 6 of the truss girder 4.

Figure 6:
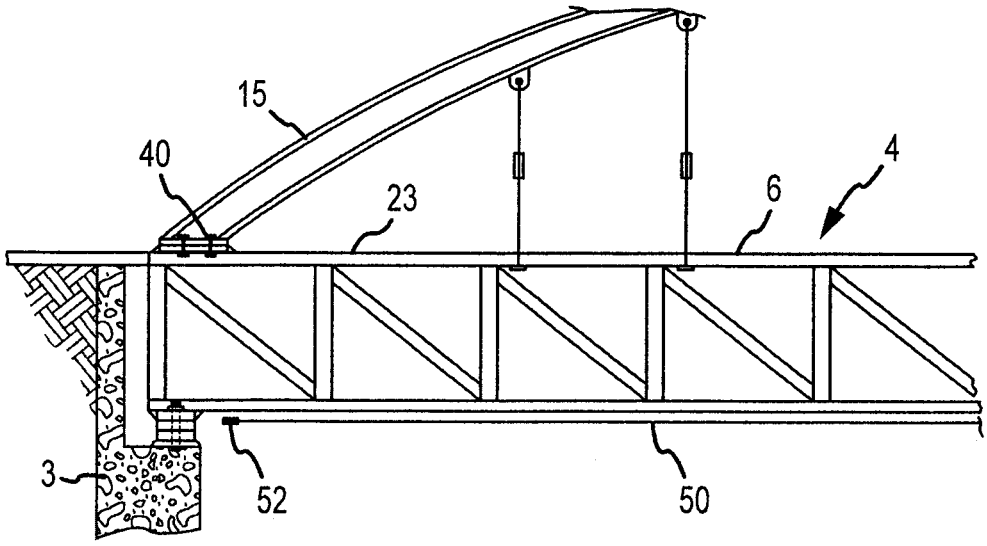
FIG. 6 is an enlarged fragmentary view of a third embodiment of the present invention where a single roadway deck is supported by the upper chords of the truss girder.
Figure 7:
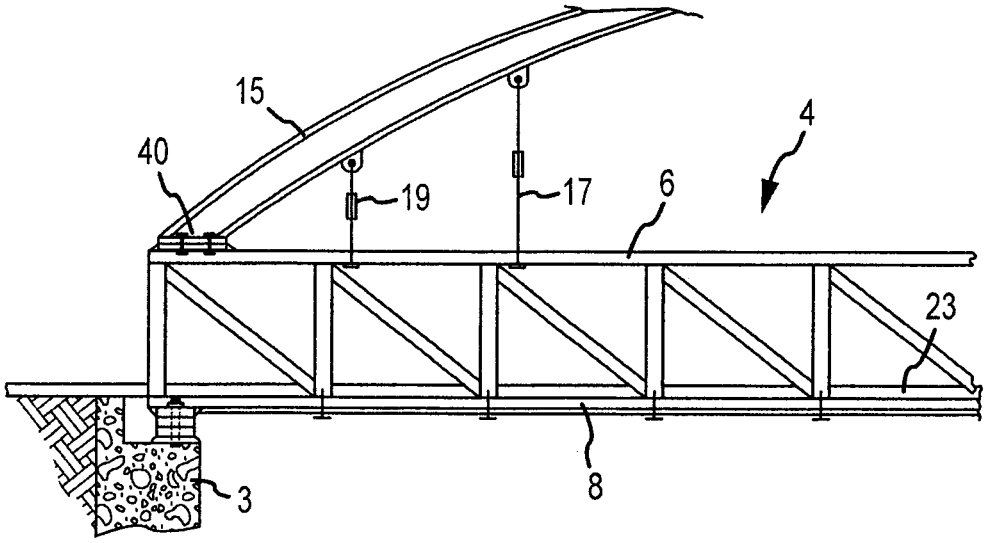
FIG. 7 is an enlarged fragmentary view of a fourth embodiment of the present invention where a single roadway deck is support by the lower chords of the truss girder.
Figure 8:
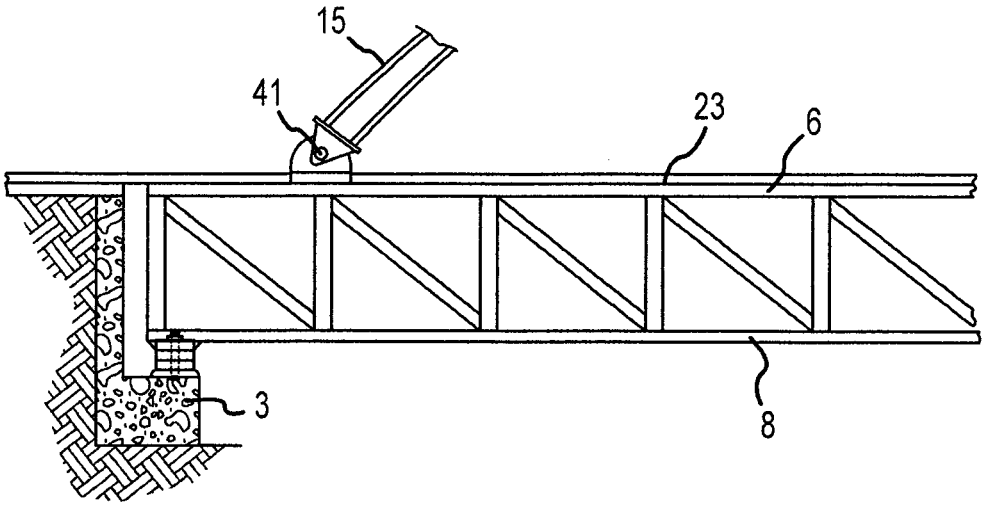
FIGS. 8 and 9 are enlarged fragmentary views of a hinged connection between the ends of an arch and the top chord of a truss girder in a structure of the present invention.
Figure 9:
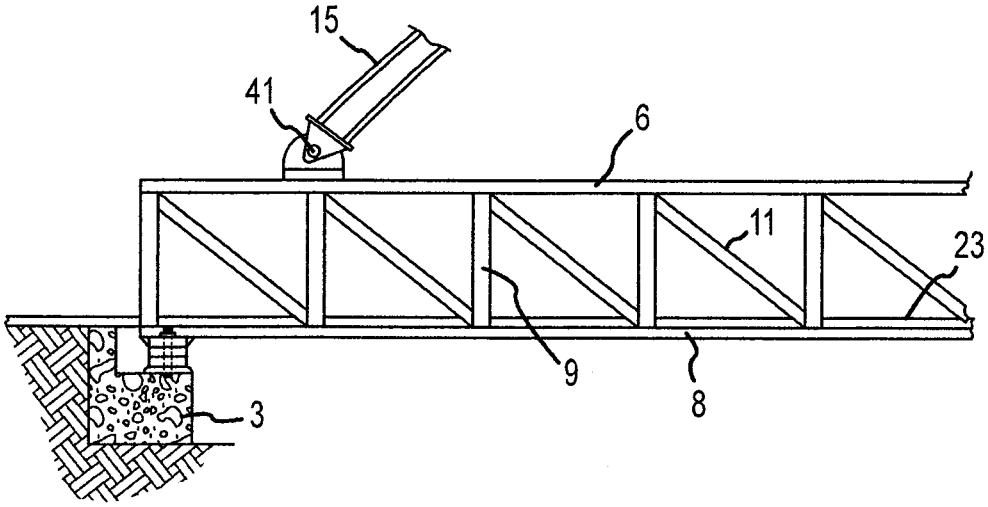

The connection of the ends of each of the arches 15 to the top chords 6 of the truss girder may be either fixed, such as a welded attachment 40 shown in FIGS. 6 and 7, or they may be hinged by a pin 41, as shown in FIGS. 8 and 9. The hinged connections are preferred because of their ability to isolate the moment forces in the arch between hinge points.

What is claimed is:

1. A bridge structure comprising, a pair of structural arches each having first and second terminal ends, a pair of truss beams disposed beneath the respective arches, each truss beam having longitudinally extending top and bottom chords, at least a portion of the length of which define a geometric chord of each arch, and where each top chord is attached to the terminal ends of the arch below which the truss beam is disposed, a plurality of spaced apart tension rods interconnecting each arch and the respective top chord of the truss beam, a plurality of first floor joists interconnecting the bottom truss chords, and a road deck supported by the first floor joists.

* * * * *